US005160797A

United States Patent [19]

Kim

[11] Patent Number: 5,160,797

[45] Date of Patent: Nov. 3, 1992

[54] STEP-RECORDING APPARATUS AND METHOD FOR AUTOMATIC MUSIC-PERFORMING SYSTEM

[75] Inventor: Jae Hyun Kim, Anyang, Rep. of Korea

[73] Assignee: Goldstar, Co., Ltd., Seoul, Rep. of Korea

[21] Appl. No.: 766,281

[22] Filed: Sep. 27, 1991

[30] Foreign Application Priority Data

Sep. 28, 1990 [KR] Rep. of Korea ..... 90-15538

[51] Int. Cl.[5] ..... G10H 1/06; G10H 1/38; G10H 7/00

[52] U.S. Cl. ..... 84/613; 84/622; 84/DIG. 22

[58] Field of Search ..... 84/613, 622-625, 84/DIG. 22, 612, DIG. 12

[56] References Cited

U.S. PATENT DOCUMENTS 4,633,751 1/1987 Fukaya et al. ..... 84/DIG. 22

*Primary Examiner*—Stanley J. Witkowski

*Attorney, Agent, or Firm*—Birch, Stewart, Kolasch & Birch

[57] ABSTRACT

A step-recording apparatus for an automatic music-performing system comprises a timber generating member, a control member, a function key block, a melody key block, and memories and a method thereof comprising the steps of setting an address of a memory for storing step-recording data, if a key signal for performing a step-recording mode routine is inputted in the courser of performing of a main routine, setting a reference resolution value of a selected melody chord, increasing or decreasing the reference resolution value by a predetermined number of times, or maintaining the reference resolution value naturally, scanning the key signals corresponding to a function and the melody chord, identifying the melody chord and a play mode from the scanned key signals and then producing a desired format of the step-recording data corresponding to the identified melody chord and play mode, and storing the step-recording data into the memory, increasing the address of the memory by a predetermined unit and then returning the operation to the initial state.

8 Claims, 6 Drawing Sheets

STEP-RECORDING APPARATUS AND METHOD FOR AUTOMATIC MUSIC-PERFORMING SYSTEM

BACKGROUND OF THE INVENTION

1. Field of the Invention

The present invention relates in general to an automatic music-performing system, and more particularly to step-recording apparatus and method for the automatic music-performing system.

2. Description of the Prior Art

In the beginning of an automatic music-performing system such as keyboard instruments, there has been provided a synthesizer for synthesizing melodies such as do, re, mi, fa, . . . do, to produce a desired sound. However, nobody, except professional musicians, could use the synthesizer in that the synthesizer was difficult to use and expensive.

To meet ordinary person's expectations, there has thereafter been proposed an electronic keyboard (EKB) instrument in which are stored a predetermined number of rhythms (i.e., disco, tango and etc.) and melody chords.

The EKB instrument are typically comprised of rhythm keyboards and melody keyboards. The user selects a desired rhythm with the left hand and melody chords such as C, Am, G, . . . etc. with the right hand, in order to make a desired musical performance. However, this is difficult for the ordinary person to use, too, in that it requires a great amount of skill. Namely, the EKB instrument is difficult to play in real time.

For instance, in the case where the melody chord C is to be played, the user has to select a desired rhythm with the left hand at the same time as a root key and a chord identification (ID) key for the melody chord C with the right hand, and a desired time for generation of the melody chord C, hereinafter referred to as resolution, as well. For this reason, the EKB instrument is difficult for the ordinary person to play. Also, when a desired melody chord is hard to play such as C#, dim, Caug and etc. and a desired rhythm is fast, the EKB instrument is even more difficult to play.

For the purpose of solution of the above problems, there has recently been developed a recording apparatus for automatic music-performing system such as the keyboard instruments, which is capable of pre-recording a predetermined musical performance and thereafter playing back the recorded musical performance.

This apparatus is different in manner from the conventional recording apparatus for the automatic music-performing system which is capable of recording a predetermined musical performance, typically on magnetic tape, in that it records on a memory, musical performance information from a performer, i.e. numbers of the selected melody chords, the intensity of pushing the keyboard, the time wherein the keyboard is pushed and etc., as digital data.

There has initially been utilized a recording apparatus of the one track recording type which is capable of recording a desired rhythm and melody at the same time but there has recently been utilized a recording apparatus of multi-track recording type which is capable of recording individually the rhythm, the melody and etc. on different tracks, to follow the trend of variety of functions.

However, the recording apparatus of the one track recording type records in real time and the performer plays his or her musical performance with the rhythm having a tempo selected from the beginning to the end on the turning-on of the recording apparatus. For this reason, when the performer is out of tempo because he or she lacks rhythmical sense, does not understand fingering of the melody chord and lacks in use of the keyboard, the recording is ruined and thus the recording apparatus must do it all over again.

Therefore, recently a recording apparatus of the multi-track recording type there has broadly been utilized.

With reference to FIG. 1, there is shown a block diagram of a recording apparatus for an automatic music-performing system in accordance with the known prior art. The illustrated apparatus comprises timbre generating means 1 for generating a desired timbre of a sound being inputted in accordance with an external control signal, a function key block 2 for selecting desired rhythm and tempo and a play mode, a melody key block 3 for selecting a melody chord of a musical performance, a ROM 4 for storing a system program and a predetermined number of sound data, a RAM 5 for storing or accessing data of melodies produced by a performer in accordance with an external control signal, a microcomputer 6 for providing a plurality of control signals to the system in response to key signals from the function key block 2 and the melody key block 3, and an interface 7 for passing information, corresponding to a kind of timbre of the selected sound, to an address corresponding to the ROM location in which the corresponding timbre is stored and to a duration and pitch of the corresponding timbre, from the microcomputer 6 to the timbre generating means 1 in accordance with a given parameter protocol.

The timbre generating means 1 includes a ROM 8 for storing a plurality of timbre data from the timbre generating means 1 in a pulse code modulation (PCM) manner, a RAM 9 for dividing the information being received from the interface 7 into four parameters and outputting the four parameters, and an address generator 10 for generating an address in accordance with the first parameter from the RAM 9 and applying the address to the ROM 8. Upon being applied with the address from the address generator 10, the ROM 8 outputs a specific timbre of data.

Also, the timbre generating means includes an envelope generator 11 for generating a predetermined envelope in accordance with the second parameter from the RAM 9, an interpolator 12 for smoothing a high frequency component of the timbre data from the ROM 8 in accordance with the third parameter from the RAM 9, a digital/analog converter 13 for converting an output signal from the interpolator 12 into an analog signal, an attenuator 14 for attenuating an output signal from the digital/analog converter 13 with the lapse of time in accordance with the envelope from the envelope generator 11, and an analog switch 15 for selecting, in accordance with a software of the system program, one of the channels through which a timbre output signal from the attenuator 14 is finally outputted. The channels may be rhythm high, rhythm low, base and melody channels.

To explain the function of the envelope generator 11 in more detail, the envelope generator 11 functions to generate the envelope for determining a form into which the timbre data from the ROM 8 is varied with variation of time, in accordance with the second parameter from the RAM 9.

Also to explain the function of the interpolator 12 in more detail, the function of the interpolator 12 is to compensate for a conversion error which may be generated when the timbre digital data is converted into an analog signal.

The other will later be described in detail with reference to the operation of the apparatus.

On the other hand, the microcomputer 6 includes a port 16 connected to the interface 7, a port 17 connected to the function key block 2 and the melody key block 3, ports 18 and 19 connected to the RAM 5 for recording the musical performance and to the ROM 4 for storing the system program and sound data, a RAM 20 and a register 21 for being used when the microcomputer 6 performs an arithmetic function, a timer 22 for adjusting a tempo in accordance with an external interrupt control signal, an interrupt controller 23 for controlling a priority and a service of an interrupt signal being generated from the timer 22, an arithmetic logic unit (ALU) 24, latches 25 and 26, and an internal data bus 27.

The operation of the conventional recording apparatus with the above-mentioned construction will now be described with reference to FIG. 2.

With reference to FIG. 2, there is shown a flow chart illustrating the operation of the apparatus shown in FIG. 1.

First, once the user operates the function key block 2, the selected rhythm and metronome numbers, or tempo number are placed o the internal data bus 27 in the microcomputer 6 through the port 17. At this time, the microcomputer 6 calculates a parameter to drive the timer 22 in accordance with the system program stored in the ROM 4, using the RAM 20, the register 21 and the arithmetic logic unit 24. The timer 22 in the microcomputer 6 counts a system clock signal being generated as shown in FIG. 3*a* by a predetermined number of times in accordance with the parameter and generates the interrupt signal as shown in FIG. 3*b*, one time.

Then, in accordance with the system program in the ROM 4, the interrupt signal being generated from the timer 22 is counted by a predetermined number of times, resulting in the generation of a tempo period required by the user, as shown in FIG. 3*c*.

At the same time, the user operates the melody key block 3 to apply melody key signals and their resolution values corresponding to intervals of the tempo to the microcomputer 6. As a result, the microcomputer 6 inputs a key signal being generated in the course o its scanning of the melody key block 3 and then performs a mode for detecting a melody chord corresponding to the inputted key signal.

Upon the detection of the melody chord corresponding to the melody key, the detected melody chord, together with the resolution value (beat value or time base value) wherein the melody chord is maintained, is stored in the RAM 5 for recording the musical performance. Also, the microcomputer 6 transfers one of the plurality of sound data stored in the ROM 4, the detected melody chord, its resolution value and pitch value and function data to the timbre generating means 1, in accordance with the key signals being applied by the user operating the function block 2 and the melody key block 3. Then, the RAM 9 in the timbre generating means 1 divides the signal being received from the interface 7 into four parameters, the first, address parameter, the second, envelope parameter, the third, interpolating parameter and the fourth, switching parameter and outputs the four parameters. The address generator 10 generates an address in accordance with the first parameter from the RAM 9 and applies the address to the ROM 8. Upon being applied with the address from the address generator 10, the ROM 8 outputs a specific timbre of digital data in the location corresponding to the applied address.

The envelope generator 11 generates an envelope for determining an attenuation degree of the timbre data from the ROM 8 being varied with variation of time, in accordance with the second parameter from the RAM 9. Also, the interpolator 12 smooth a high frequency component of the timbre data from the ROM 8 in accordance with the third parameter from the RAM 9. Then, the attenuator 14 inputs the envelope from the envelope generator 11 simultaneously with the timbre data through the interpolator 12 and the analog/digital converter 13 and attenuates the inputted timbre data in accordance with the envelope from the envelope generator 11.

FIG. 4(*a*)–4(*c*) comprise waveforms of signals from respective components in the timbre generating means 1, wherein FIG. 4*a* is a waveform diagram of the timbre digital data stored in the ROM 8, FIG. 4*b* is a waveform diagram of an output signal from the envelope generator 11 and FIG. 4*c* is a waveform diagram of an output signal from the attenuator 14. On the other hand, the output signal from the attenuator 14 is outputted through one of the rhythm high, rhythm low, melody and base channels by the analog switch 15 in accordance with the sort of the timbre.

With the reference to FIG. 5, there is shown the data format of a melody key chord being stored in the recording RAM 5, its play mode and resolution value, this data format having been proposed by the present inventor. As shown in this drawing, two bytes of data are stored in the RAM 5 for recording the musical performance, the first byte data being data corresponding to the root and identification (ID) of the melody chord and the second byte data being data corresponding to the resolution and play mode of the melody chord. The play mode may include "intro" for use in an introduction portion of the musical performance, "ending" for use in an end portion of the musical performance, "fill-in" for use in change of measures of the musical performance, and "main" for use in a monotonic portion of the musical performance.

An example of identification (ID) data, root data and play mode data, being preset for recording the melody chord is as follows:

TABLE 1

| Chord ID | | | | | | |
|---|---|---|---|---|---|---|
| Major | Minor | Dom7 | Minor7 | Major7 | Minor Major | augment |
| 0000 | 0001 | 0010 | 0011 | 0100 | 0101 | 0110 |

TABLE 2

| | | | | | | Root | | | | | |
|---|---|---|---|---|---|---|---|---|---|---|---|
| C | D♭ | D | E♭ | E | F | F# | G | A♭ | A | B♭ | B |
| 0000 | 0001 | 0010 | 0011 | 0100 | 0101 | 0110 | 0111 | 1000 | 1001 | 1010 | 1011 |

TABLE 3

| | Play Mode | | | | |
|---|---|---|---|---|---|
| Main | intro | Fill-in1 | Fill-in2 | Fill-in3 | Fill-in4 |
| 000 | 001 | 010 | 011 | 100 | 101 |

For example, a data format for recording a piece of music as shown in FIG. 6 can be expressed by the following Table 4, utilizing the above Tables 1 through 3.

TABLE 4

| | | | | | | | | | |
|---|---|---|---|---|---|---|---|---|---|
| Ø | Ø | 0 | 0 | 0 | 0 | 0 | 0 | 0 | 0 |
| 4 | Ø | 0 | 0 | 1 | 0 | 0 | 0 | 0 | 0 |
| 9 | 1 | 1 | 0 | 0 | 1 | 0 | 0 | 0 | 1 |
| 4 | Ø | 0 | 0 | 1 | 0 | 0 | 0 | 0 | 0 |
| 2 | 1 | 0 | 0 | 1 | 0 | 0 | 0 | 0 | 1 |
| 1 | Ø | 0 | 0 | 0 | 1 | 0 | 0 | 0 | 0 |
| 7 | 2 | 0 | 1 | 1 | 1 | 0 | 0 | 1 | 0 |
| 1 | Ø | 0 | 0 | 0 | 1 | 0 | 0 | 0 | 0 |
| Ø | Ø | 0 | 0 | 0 | 0 | 0 | 0 | 0 | 0 |
| 2 | 2 | 0 | 0 | 1 | 0 | 0 | 0 | 1 | 0 |

However, the conventional recording apparatus for the automatic music-performing system has a disadvantage, in that it utilizes a real time recording procedure wherein the melodies constituting the musical performance are recorded simultaneously with the rhythm having a constant tempo, thereby causing the unskilled performer to be frequently out the tempo. For this reason, it is impossible to insert the corresponding melody chords into respective intervals of the tempo. Hence, the recording is ruined and thus the recording apparatus must do it all over again. For instance, in a case where two or more hard melody chords are contained in a bar as shown in FIG. 7, it is particularly difficult for the user to insert the corresponding melody chords into respective intervals of the tempo of the selected rhythm in accordance with the tempo of the selected rhythm.

SUMMARY OF THE INVENTION

Accordingly, it is an object of the present invention to provide a step-recording apparatus and method for an automatic music-performing system, for first recording a progression of melody chords of a musical performance one at a time in the absence of a predetermined tempo or rhythm and then inserting the predetermined tempo or rhythm while playing back the melody chords, so that the recording the musical performance can more readily be performed.

In accordance with the one aspect of the present invention, there is provided a step-recording apparatus for an automatic music-performing system comprising: timbre generating means for generating a desired timbre of a sound being inputted in accordance with an external control signal; a first key block for selecting a desired function; a second key block for selecting a desired melody chord of a musical performance; a third key block for providing a plurality of key signals for performing a step-recording mode of progressing of the melody chord of the musical performance; first storing means for storing a system program and a plurality of sound data and providing the desired sound data to the timbre generating means in accordance with an external control signal; second storing means for storing and outputting step-recording data corresponding to progressions of the melody chord of the musical performance in accordance with an external control signal; and control means responsive to the key signals from the first through third key blocks, for producing the step-recording data corresponding to progressions of the melody chord of the musical performance and providing a plurality of control signals necessary for the system operation.

In accordance with another aspect of the present invention, there is provided a method of performing step-recording in an automatic musical-performing system, comprising the steps of: (a) setting an address of a memory for storing step-recording data, if a key signal for performing a step-recording mode routine is inputted in the course of performing of a main routine; (b) setting a reference resolution value of a selected melody chord; (c) increasing or decreasing a reference resolution value by a predetermined number of times, or maintaining the established reference resolution value, in accordance with the inputted key signals for performing the step-recording mode routine; (d) scanning the key signals corresponding to a function and the melody chord; (e) identifying the melody chord and a play mode from the scanned key signals and then producing a desired format of the step-recording data corresponding to the identified melody chord and play mode; and (f) storing the step-recording data into the memory, increasing the address of the memory by a predetermined unit and then returning the operation to a initial state.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4*a* through 4*c* comprise a set of waveform diagrams of a signals from respective components in a timbre generating means shown in FIG. 1, wherein:

FIG. 4*a* is a waveform diagram of timbre digital data stored in a ROM;

FIG. 4*b* is a waveform diagram of an output signal from an envelope generator; and FIG. 4*c* is a waveform diagram of an output signal from an attenuator;

DESCRIPTION OF THE PREFERRED EMBODIMENTS

First, a construction of a step-recording apparatus for an automatic music-performing system in accordance with the present invention will be described with reference to FIG. 8.

Figure 8:
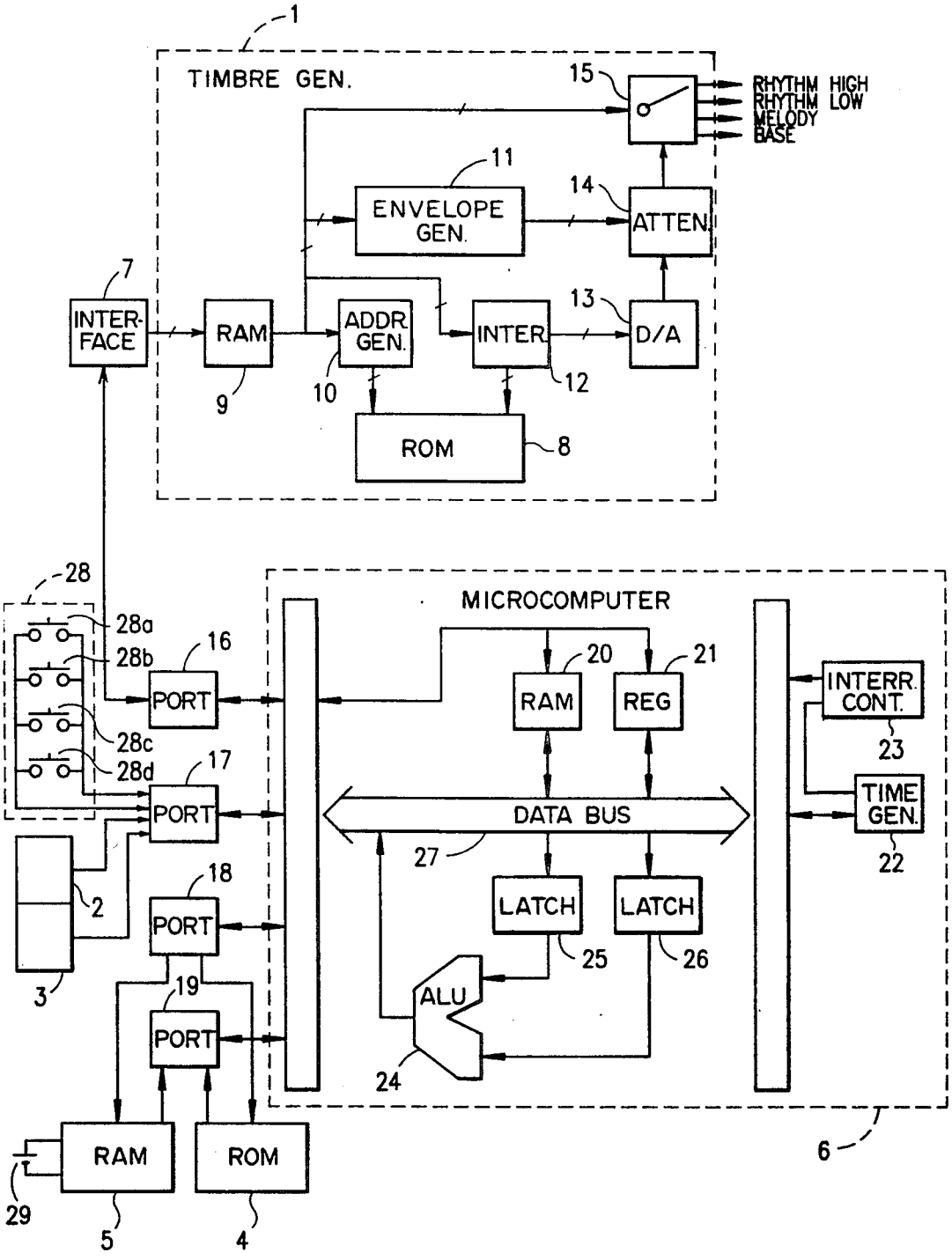
FIG. 8 is a block diagram of a step-recording apparatus for an automatic music-performing system in accordance with the present invention.

With reference to FIG. 8, there is shown a block diagram of a step-recording apparatus for an automatic music-performing system in accordance with the present invention. As shown in this drawing, the step-recording apparatus for the automatic music-performing system in accordance with the present invention comprises timbre generating means 1 for generating a desired timbre of a sound being inputted in accordance with an external control signal, a function key block 2 for selecting desired rhythm and tempo and a play mode, a melody key block 3 for selecting a melody chord of a musical performance, a step-recording mode key block 28 for providing a plurality of key signals for performing a step-recording mode, ROM 4 for storing a system program and a predetermined number of sound data, a RAM 5 for storing or accessing data of melodies produced by a performer in accordance with an external control signal, a microcomputer 6 for providing a plurality of control signals to the system in response to key signals from the function key block 2, the melody key block 3 and the step-recording mode key block 28, and an interface 7 for passing information, corresponding to a kind of timbre of the selected sound, to an address corresponding to the ROM location in which the corresponding timbre is stored and to a duration and pitch of the corresponding timbre, from the microcomputer 6 to the timbre generating means 1 in accordance with a given parameter protocol.

Herein, the reference numeral 29, not described, designates a back-up power source for applying a back-up power to the RAM 5.

Also, output signals from the analog switch 15 as a output stage of the timbre generating means 1 are filtered through respective filters (not shown) corresponding to channels in accordance with the corresponding channels, and then the filtered signals are amplified by a predetermined amplification degree by corresponding amplifiers, not shown.

Figure 1:
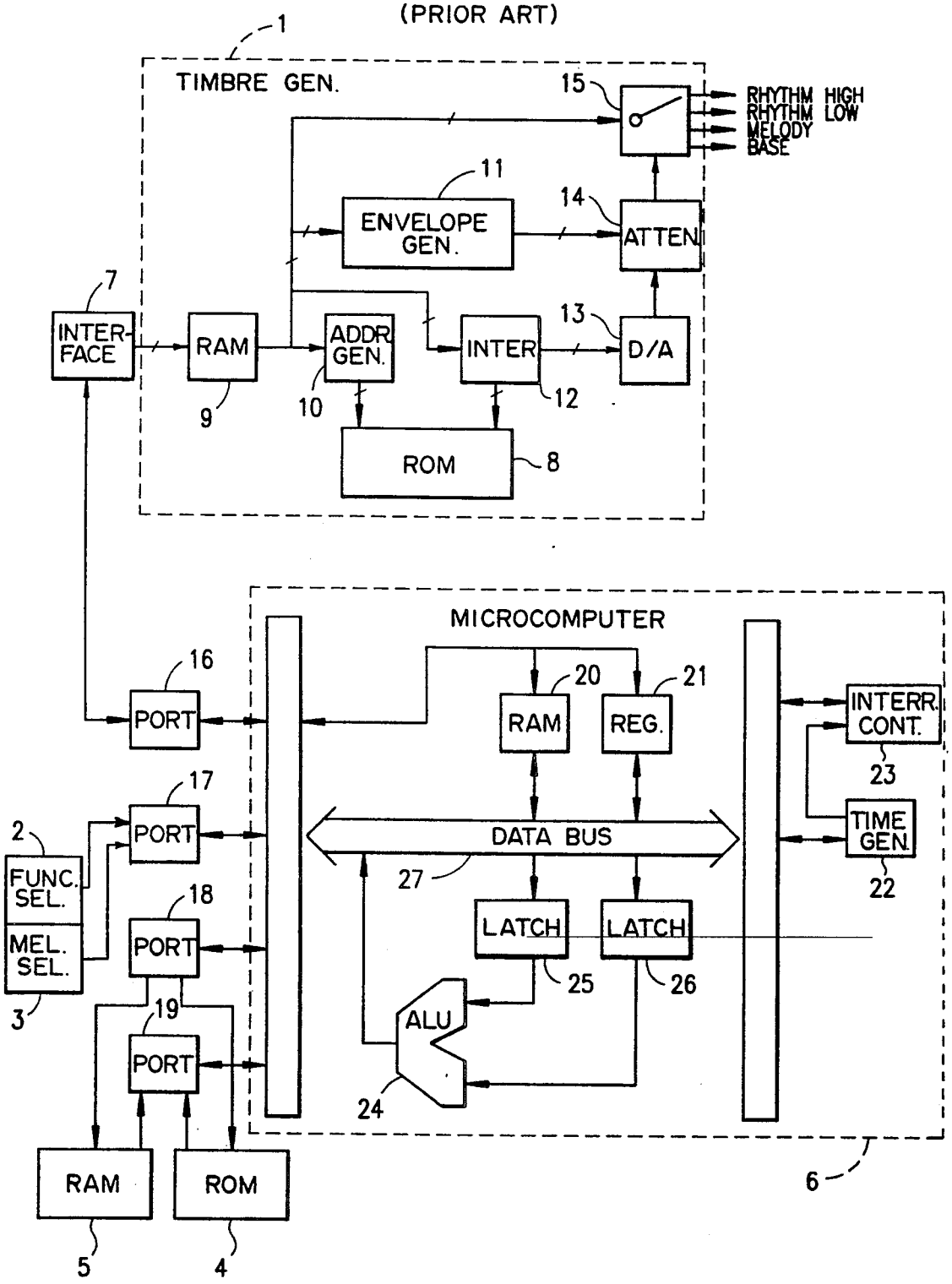
FIG. 1 (PRIOR ART)
FIG. 1 is a block diagram of a recording apparatus for an automatic music-performing system in accordance with the prior art.

The construction of the step-recording apparatus of the present invention as shown in FIG. 8 is the same as that in FIG. 1, with the exception that the port 17 of the microcomputer 6 is connected to the step-recording mode key block 28, in addition to the connection to the function key block 2 and the melody key block 3.

Figure 2:
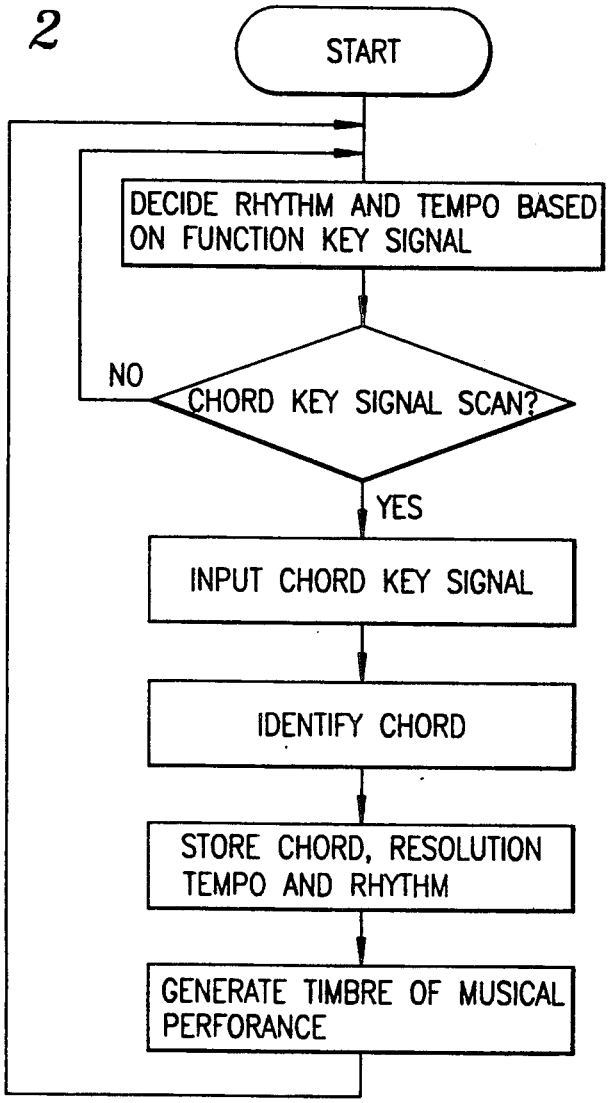
FIG. 2 is a flowchart illustrating the operation of the apparatus shown in FIG. 1.
Figure 3:
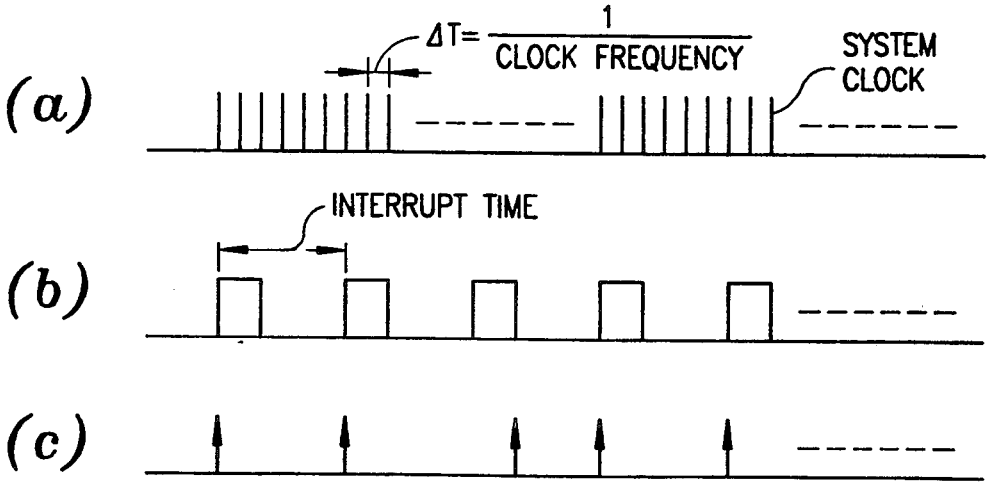
FIG. 3*a* through 3*c* illustrate the operation of a microcomputer shown in FIG. 1.
Figure 4A:
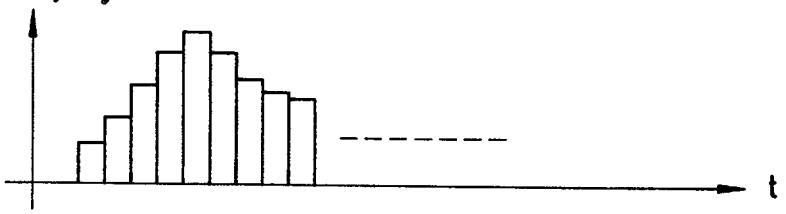
Figure 4B:
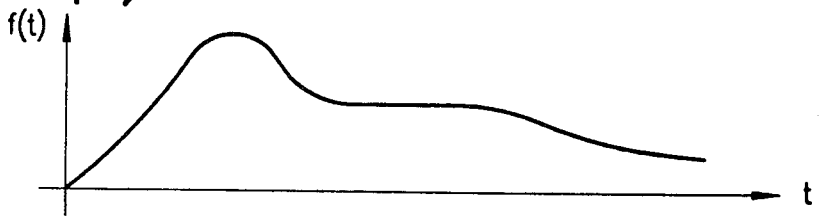
Figure 4C:
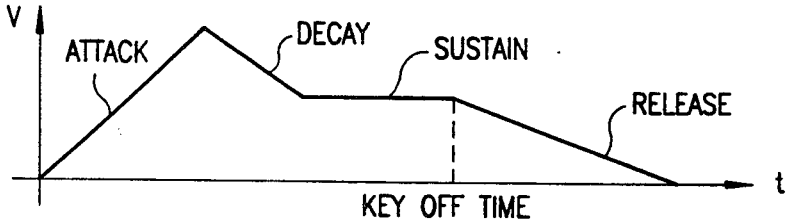

In addition, in the system program stored in the ROM 4 in FIG. 4, there is added a routine for performing the step-recording. Therefore, explanation of the construction and operation previously described with reference to FIGS. 1 and 2 may be omitted herein.

The step-recording mode key block 28 includes a step-recording key 28*a* for switching over the operation from a main routine to a step-recording mode routine and then returning the operation from the step-recording mode routine to the main routine after completion of the step-recording, a resolution increase key 28*b* for increasing a reference resolution value of a selected melody chord by a predetermined number of times, a resolution decrease key 28*c* for decreasing the reference resolution value of the selected melody chord by a predetermined number of times, and an enter key 28*d* for confirming scanning of the key signals corresponding to the step-recording mode routine, the increase and decrease of the resolution value, the melody chords and functions.

Figure 9:
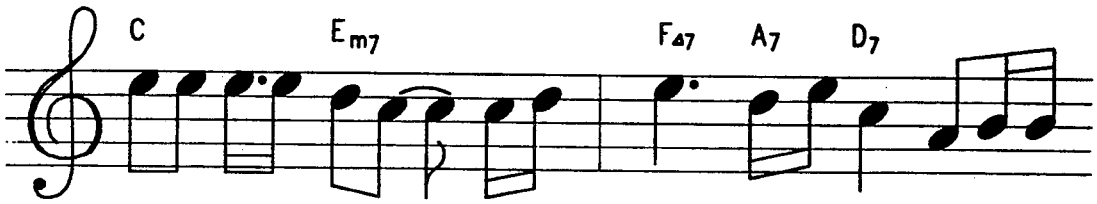
FIG. 9 is a piece of music for illustrating the operation of the apparatus in FIG. 8.
Figure 5:
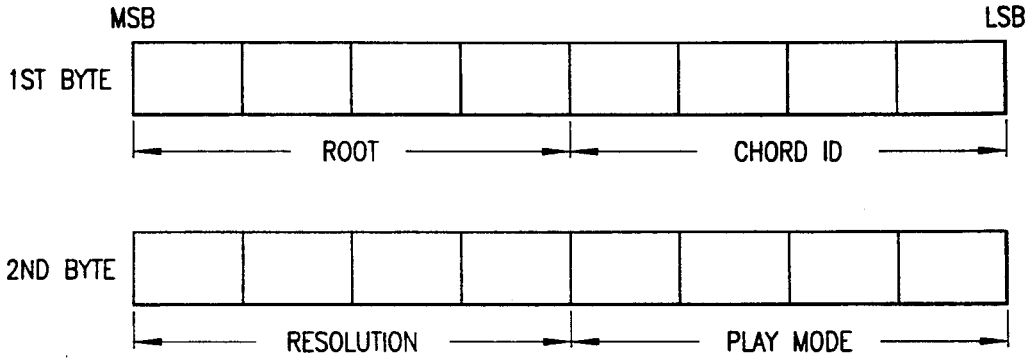
FIG. 5 is a data format of a melody key chord, its play mode and resolution value.
Figure 6:
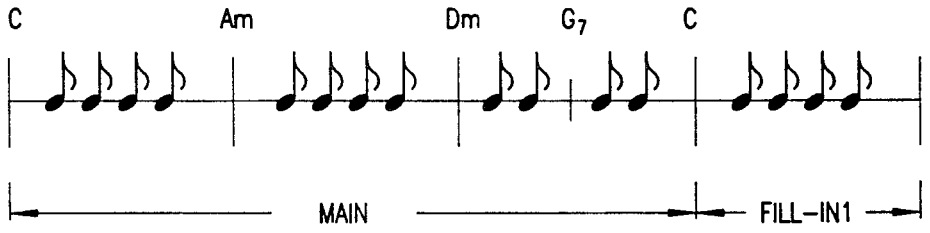
FIG. 6 is a piece of music for illustrating the operation of the apparatus in FIG. 1.
Figure 7:
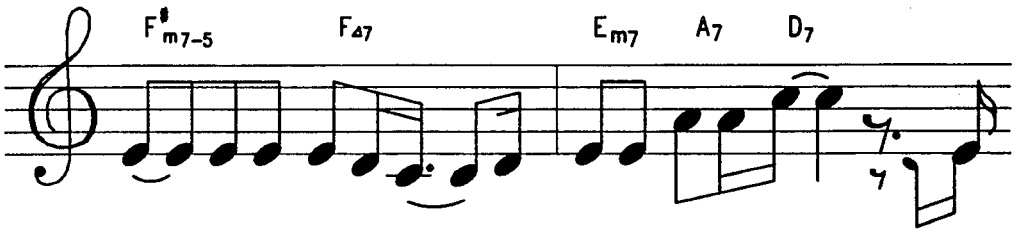
FIG. 7 is a piece of another music for illustrating the operation of the apparatus in FIG. 1.

Before description of the operation of the step-recording apparatus, the resolution value will briefly be mentioned with reference to FIG. 9. The resolution value means a duration of each of melody the chords constituting a musical performance. In order to step-record two bars of the musical performance as shown in FIG. 7, a reference resolution value is set to a quarter note "d". For the purpose of understanding of the resolution value, for another example, in order to step-record two bars of the musical performance as shown in FIG. 9, the reference resolution value is set to a half note "d", namely, the reference resolution value must be set to a note length of the shortest melody chord in the progressions of the melody chords of the musical performance. In accordance with the present invention, the reference resolution value can be varied with the length of the note being varied stepwise, i.e., based on the melody chords of the musical performance.

Now, the operation of the step-recording apparatus with the above-mentioned construction in accordance with the present invention will be described in detail with reference to FIG. 10. First, the step-recording apparatus in FIG. 8 while performing the main routine checks if a step-recording mode flag SRF is on. If the step-recording mode flag SRF is on, address pointer of the RAM 5 is set; if not so, it is checked whether the step-recording key 28*a* in the step-recording mode key block 28 is on. If the step-recording key 28*a* is off, another step of the main routine is performed. If the step-recording key 28*a* is on, it is checked whether the enter key 28*d* is on. If the enter key 28*d* is on, the step-recording mode flag is set to the On state, the enter key 28*d* is reset and another step of the main routine is then performed.

If the address pointer of the RAM 5 is set, a check is made to determine whether the step-recording key 28*a* is on. If the step-recording key 28*a* is on, a reference resolution value is set. If the step-recording key 28*a* is off, the step-recording mode flag is reset, the resolution increase key 28*b*, the resolution decrease key 28*c*, the enter key 28*d* and the address pointer of the RAM 5 are reset and another step of the main routine is then preformed. If the step-recording key 28*a* is on and the reference resolution value is set, it is checked to determine whether the resolution increase key 28*b* or the resolution decrease key 28*c* is on. If the resolution increase key 28*b* is on, the reference resolution value is increased by a predetermined number of times (herein, two times) and then the resolution increase key 28*b* is reset. If the resolution decrease key 28*c* is on, the reference resolution value is decreased by a predetermined number of times (herein, a half times) and then the resolution decrease key 28*c* is reset. Also, the states of the function key block 2 and the melody key block 3, i.e., the key signals corresponding to the melody chord and the play mode are scanned.

Unless the resolution increase key 28*b* and the resolution decrease key 28*c* are on, only key signals corresponding to the melody chord and the play mode are scanned, with the reference resolution value being maintained at its preset value.

It is then checked to determine whether the enter key 28*d* is on, the operation proceeds to a step of identifying the melody chord and the play mode from the inputted key signals, since the on state of the enter key 28*d* means that the user has operated the function key block 2 and the melody key block 3 correctly. If the enter key 28*d* is off, another step of the main routine is performed, since the Off state of the enter key 28*d* means that the user has operated the function key block 2 and the melody key block 3 incorrectly.

If the melody chord and the play mode are identified, these, together with the resolution value, are converted into digital data and the digital data are then written into the RAM 5. The data format for step-recording the musical performance being stored in the RAM 5 is the same as that previously described in accordance with the prior art. Hence, the description of the data format may be omitted herein. If the recording of the step corresponding to one melody chord in this manner has been completed, the recording of the step corresponding to another melody chord is performed. Namely, the address is increased by a predetermined unit by means of the address pointer of the RAM 5, the enter key 28*d* is reset and then another step of the main routine is performed.

Figure 10:
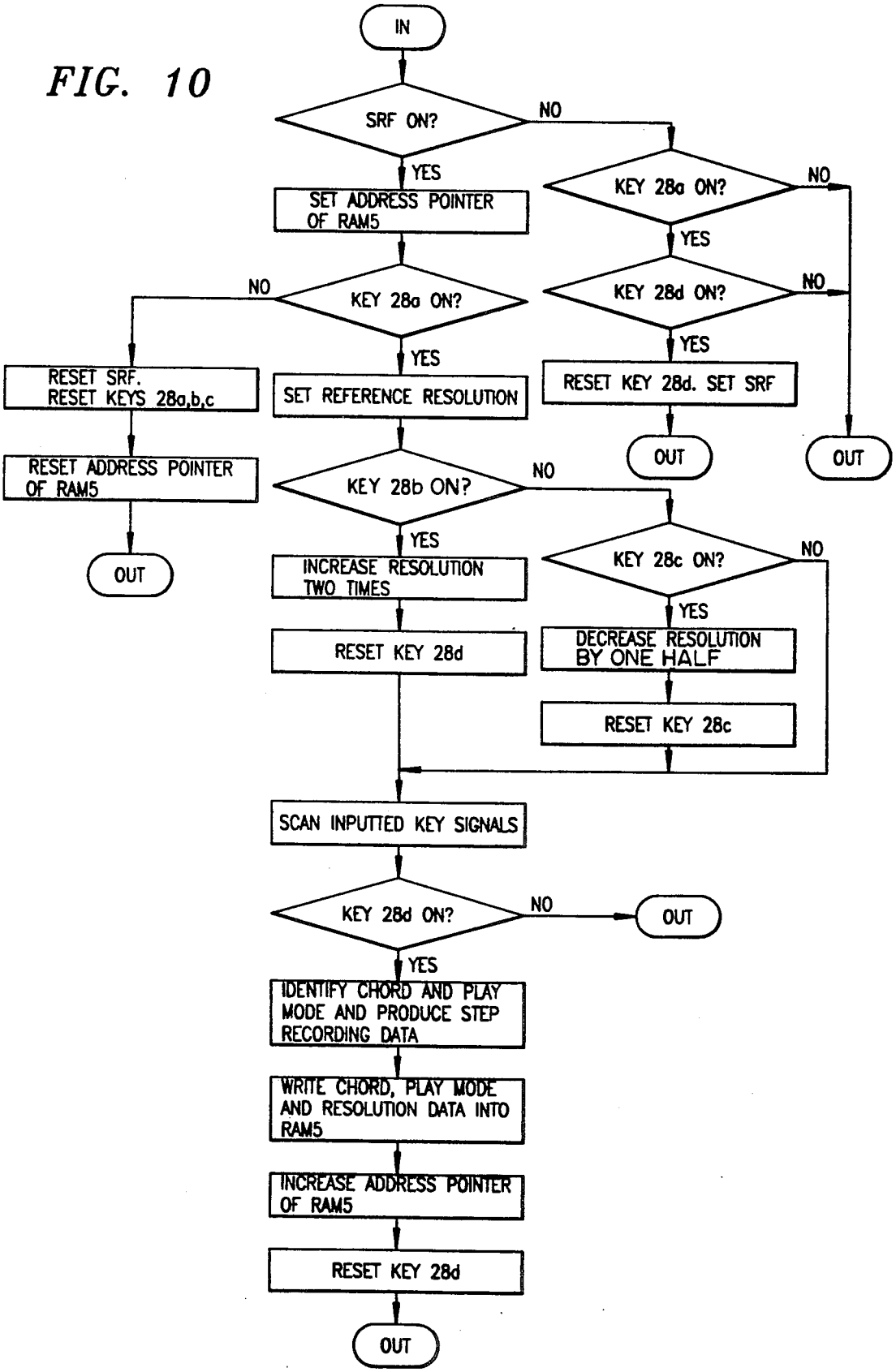
FIG. 10 is a flowchart illustrating the operation of the apparatus shown in FIG. 8.

In the flowchart of FIG. 10, the IN and OUT steps are substituted for Start and End steps, because the steps included in the flowchart are inserted in the middle of the main routine so that the steps are performed only when the key signals corresponding to step-recording mode routine are inputted in the course of the performing of the main routine.

As hereinbefore described, in accordance with the present invention, there is provided the step-recording apparatus for the automatic music-performing system, which is capable of first recording only progressions of melody chords of the musical performance by one step in the absence of a predetermined tempo of rhythm and then inserting the predetermined tempo of rhythm while playing back the melody chords. Also, the step-recording method can be performed by means of the present step-recording apparatus. Therefore, the recording of the musical performance can readily be performed, so that the unskilled user can easily play the musical performance in accordance with a desired tempo of rhythm.

It is understood that although the preferred embodiments of the present invention have been illustrated and described above, alternatives and equivalents thereof will become apparent to those skilled in the art and, accordingly, the scope of the present invention should be defined only by the appended claims and equivalents thereof.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A step-recording apparatus for an automatic music-performing system, comprising:

timbre means for generating a desired timbre of a sound inputted in accordance with an externally generated control signals, a first key block for selecting a desired function including rhythm and tempo, a second key block for selecting a desired melody chord of a musical performance, a third key block including a plurality of keys for generating a plurality of key signals for performing a step-recording mode of progressions of said desired melody chord of the musical performance in absence of a predetermined rhythm and tempo, first storing means for storing a system program, a step recording program and a plurality of desired sound data, second storing means for storing and outputting step-recording data corresponding to said progressions of said desired melody chord of the musical performance in accordance with an external control signal and providing said desired sound data to said timbre means in accordance with an external control signal, and control means coupled to said timbre means and being responsive to the key signals from said first, second and third key blocks for generating said step-recording data corresponding to said progressions of said desired melody chord of the musical performance and thereafter generating a plurality of control signals for coupling the stored step-recording data to said timbre means.

2. The step-recording apparatus of claim 1, wherein said plurality of keys of said third key block includes:

a step-recording key for switching the operation of said system from a main routine including a performance of step recorded melody chords to a step-recording mode routine including a step by step entry of selected individual chords and then returning the operation from the step-recording mode routine to the main routine after completion of the step-recording, a resolution increase key for increasing a reference resolution value of a selected melody chord by a predetermined multiplication factor, a resolution value being a time duration of each of said chords, a resolution decrease key for decreasing the reference resolution value of said selected melody chord by a predetermined division factor, and an enter key for initiating a scanning of the key signals corresponding to said step-recording mode routine, the increase and decrease of the resolution value, the melody chords and functions.

3. The apparatus of claim 2 wherein said multiplication and division factor is an integer.

4. The apparatus of claim 3 wherein said integer comprises the numeral 2.

5. A method of performing step-recording of a predetermined sequence of melody chords in an automatic musical-performing system, comprising the steps of:

(a) switching from a main routine to step-recording routine stored in a first memory and setting an address of a second memory for storing step-recording data in response to a key signal generated upon the manual actuation of first switch means in the course of performing of a main routine, (b) keying in a selected melody chord and setting a reference resolution value of the selected melody chord, said reference resolution value being a predetermined time duration of said selected melody chord, (c) increasing or decreasing the reference resolution value of said melody chord by a predetermined factor upon the manual actuation of respective second and third switch means during said step-recording routine, or maintaining said reference resolution value (d) scanning the key signals generated in response to said selected melody chord, (e) identifying said selected melody chord and generating a desired format of step-recording data corresponding to said selected melody chord, (f) generating an enter function key signal upon manual actuation of fourth switch means and storing the step-recording data into the second memory in absence of rhythm and tempo, increasing the address of the second memory by a predetermined unit and then returning the operation to an entry state for the next melody chord in said sequence, (g) outputting the step-recording data in said second memory, and (h) inserting rhythm and tempo stored in another memory during a play mode of said main routine for generating a musical performance.

6. The method of performing step-recording in an automatic musical-performing system of claim 5 and further comprising the step of:

(i) confirming whether or not the scanned key signals are correct between said steps (d) and (e).

7. The method of claim 5 wherein said predetermined factor for increasing the reference resolution value is a whole number and said predetermined factor for decreasing the reference resolution factor is a fraction.

8. The method of claim 7 wherein said whole number comprises the numeral 2 and said fraction comprises ½.

* * * * *